US005774995A

United States Patent [19]

Ross

[11] Patent Number: 5,774,995

[45] Date of Patent: Jul. 7, 1998

[54] CANDLE SHARPENING SYSTEM

[76] Inventor: Richard M. Ross, 2369 Belcaro Way, Mississauga, Ontario, Canada, L5M 2M6

[21] Appl. No.: 736,135

[22] Filed: Oct. 24, 1996

[51] Int. Cl.[6] ..... B43L 23/08

[52] U.S. Cl. ..... 30/454; 30/457

[58] Field of Search ..... 30/451, 454, 457, 30/278; 144/155, 156, 28.1, 28.11

[56] References Cited

U.S. PATENT DOCUMENTS

| | | | |
|---|---|---|---|
| 832,446 | 10/1906 | Baines | 30/457 |
| 847,363 | 3/1907 | Parrish | 30/457 |
| 1,451,163 | 4/1923 | Hope | 30/451 |
| 2,691,960 | 10/1954 | Leeds et al. | 30/454 |
| 2,702,022 | 2/1955 | Fors | 30/451 |
| 3,242,526 | 3/1966 | Wilton et al. | 30/451 |
| 3,869,794 | 3/1975 | Smith | 30/451 |
| 4,066,109 | 1/1978 | Narang et al. | 30/457 |
| 4,158,912 | 6/1979 | Erdmann | 30/454 |
| 4,402,354 | 9/1983 | Halpern | 30/454 |

FOREIGN PATENT DOCUMENTS

| | | | |
|---|---|---|---|
| 133762 | 6/1933 | Australia | 30/454 |
| 1051165 | 2/1959 | Germany | 30/454 |
| 1268019 | 5/1968 | Germany | 30/457 |

*Primary Examiner*—Hwei-Siu Payer

[57] ABSTRACT

A new Candle Sharpening System for shaping a new or a used candle into various selective shapes thereby extending the useful and aesthetically pleasing life of the candle. The inventive device includes a base having a passage, a conical member secured to the base and surrounding the passage at one end, a slot along the edge of the conical member, and an interchangeable blade of a selected shape secured to the conical member within the slot projecting into the interior portion of the conical member to engage the candle.

8 Claims, 3 Drawing Sheets

CANDLE SHARPENING SYSTEM

BACKGROUND OF THE INVENTION

1. Field of the Invention

The present invention relates to Sharpening Devices and more particularly pertains to a new Candle Sharpening System for shaping a new or a used candle into various selective shapes thereby extending the useful and aesthetically pleasing life of the candle.

2. Description of the Prior Art

The use of Sharpening Devices is known in the prior art. More specifically, Sharpening Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Sharpening Devices include U.S. Pat. No. 3,869,794; U.S. Pat. No. 4,506,716; U.S. Pat. No. 4,158,912; U.S. Pat. No. 5,020,221; U.S. Pat. No. 4,217,799 and U.S. Pat. No. 4,081,010.

While these devices fulfill their respective, particular objectives and requirements, the aforementioned patents do not disclose a new Candle Sharpening System. The inventive device includes a base having a passage, a conical member secured to the base and surrounding the passage at one end, a slot along the edge of the conical member, and a interchangeable blade of a selected shape secured to the conical member within the slot projecting into the interior portion of the conical member to engage the candle.

In these respects, the Candle Sharpening System according to the present invention substantially departs from the conventional concepts and designs of the prior art, and in so doing provides an apparatus primarily developed for the purpose of shaping a new or a used candle into various selective shapes thereby extending the useful and aesthetically pleasing life of the candle.

SUMMARY OF THE INVENTION

In view of the foregoing disadvantages inherent in the known types of Sharpening Devices now present in the prior art, the present invention provides a new Candle Sharpening System construction wherein the same can be utilized for shaping a new or a used candle into various selective shapes thereby extending the useful and aesthetically pleasing life of the candle.

The general purpose of the present invention, which will be described subsequently in greater detail, is to provide a new Candle Sharpening System apparatus and method which has many of the advantages of the Sharpening Devices mentioned heretofore and many novel features that result in a new Candle Sharpening System which is not anticipated, rendered obvious, suggested, or even implied by any of the prior art Sharpening Devices, either alone or in any combination thereof.

To attain this, the present invention generally comprises a base having a passage, a conical member secured to the base and surrounding the passage at one end, a slot along the edge of the conical member, and an interchangeable blade of a selected shape secured to the conical member within the slot projecting into the interior portion of the conical member to engage the candle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Candle Sharpening System apparatus and method which has many of the advantages of the Sharpening Devices mentioned heretofore and many novel features that result in a new Candle Sharpening System which is not anticipated, rendered obvious, suggested, or even implied by any of the prior art Sharpening Devices, either alone or in any combination thereof.

It is another object of the present invention to provide a new Candle Sharpening System which may be easily and efficiently manufactured and marketed.

It is a further object of the present invention to provide a new Candle Sharpening System which is of a durable and reliable construction.

An even further object of the present invention is to provide a new Candle Sharpening System which is susceptible of a low cost of manufacture with regard to both materials and labor, and which accordingly is then susceptible of low prices of sale to the consuming public, thereby making such Candle Sharpening System economically available to the buying public.

Still yet another object of the present invention is to provide a new Candle Sharpening System which provides in the apparatuses and methods of the prior art some of the advantages thereof, while simultaneously overcoming some of the disadvantages normally associated therewith.

Still another object of the present invention is to provide a new Candle Sharpening System for shaping a new or a used candle into various selective shapes thereby extending the useful and aesthetically pleasing life of the candle.

Yet another object of the present invention is to provide a new Candle Sharpening System which includes a base having a passage, a conical member secured to the base and surrounding the passage at one end, a slot along the edge of the conical member, and a interchangeable blade of a selected shape secured to the conical member within the slot projecting into the interior portion of the conical member to engage the candle.

Still yet another object of the present invention is to provide a new Candle Sharpening System that extends the life a candle that has been utilized.

Even still another object of the present invention is to provide a new Candle Sharpening System that increases the appearance of used candles making them more decorative and appealing when on display.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
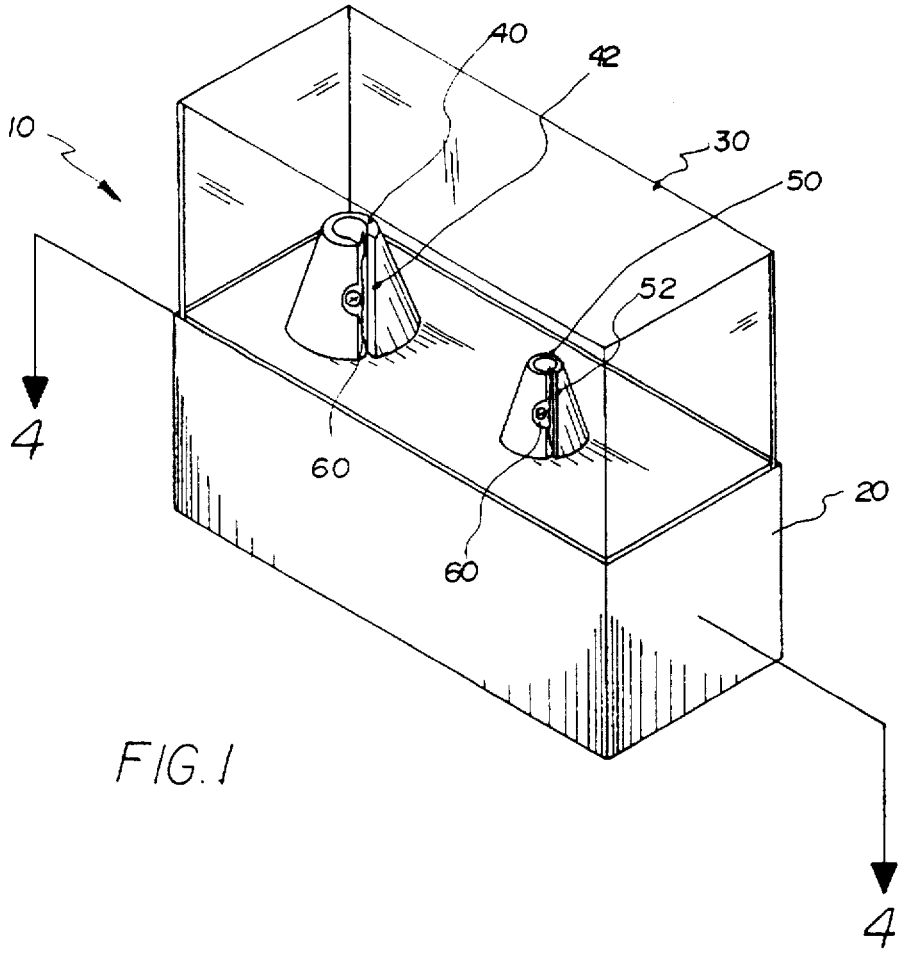
FIG. 1 is an upper side perspective view of a new Candle Sharpening System according to the present invention.

With reference now to the drawings, and in particular to FIGS. 1 through 7 thereof, a new Candle Sharpening System embodying the principles and concepts of the present invention and generally designated by the reference numeral 10 will be described.

More specifically, it will be noted that the Candle Sharpening System 10 comprises a base 20 having a passage 22, a conical member 40 secured to the base 20 and surrounding the passage 22 at one end, a slot 42 along the edge of the conical member 40, and an interchangeable blade 60 of a selected shape secured to the conical member 40 within the slot 42 projecting into the interior portion of the conical member 40 to engage an unnumbered candle.

Figure 2:
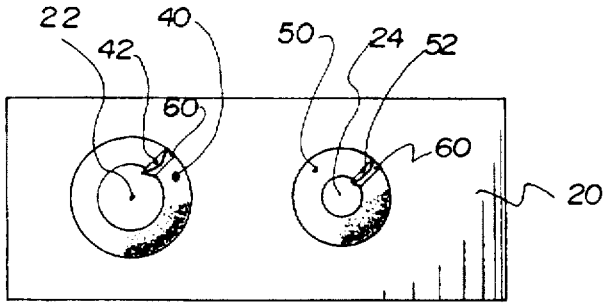
FIG. 2 is a bottom view of the present invention.
Figure 3:
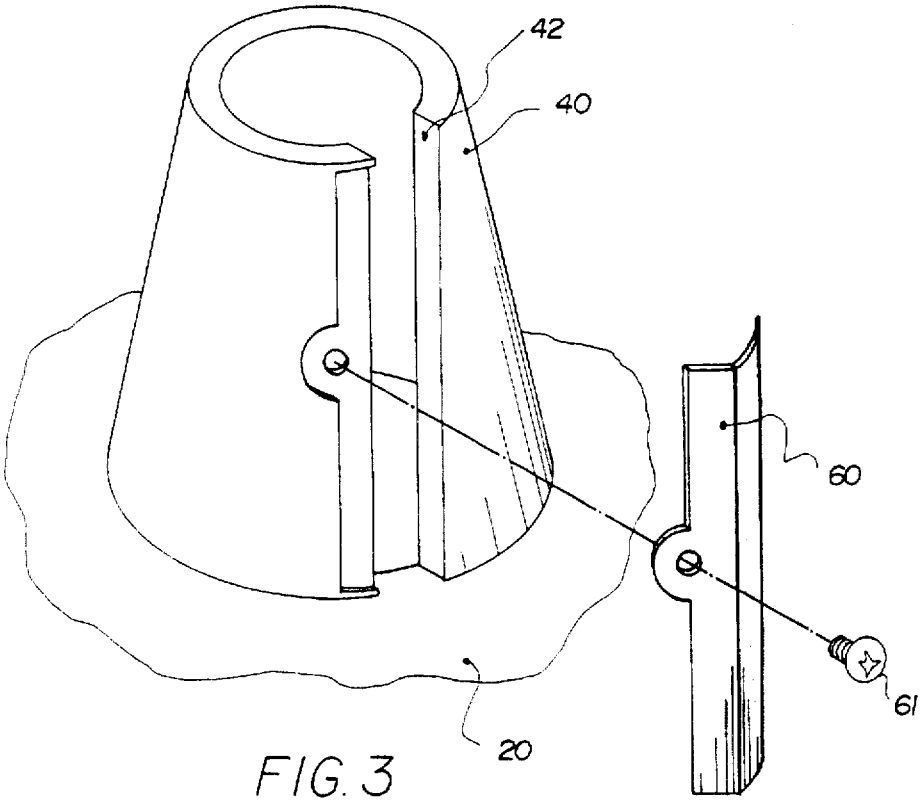
FIG. 3 is a magnified view of the conical member.
Figure 4:
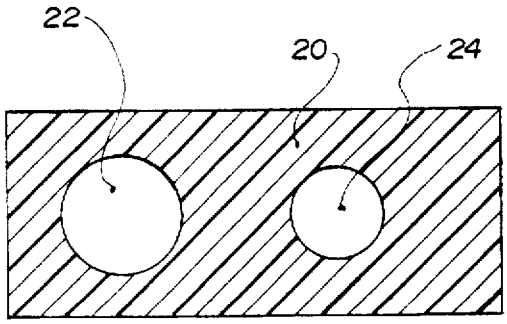
FIG. 4 is a cross sectional view taken along line 4—4 of FIG. 1.
Figure 5:
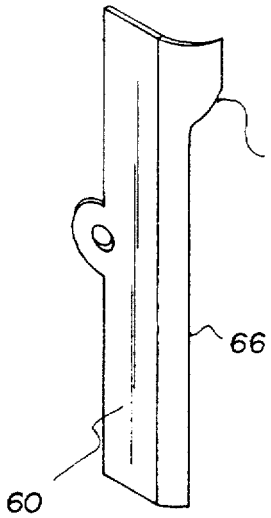
FIG. 5 is an upper side perspective view of an alternative embodiment of the blade disclosing an arcuate member.
Figure 6:
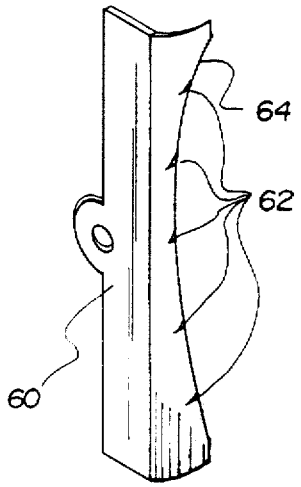
FIG. 6 is an upper side perspective view of another alternative embodiment of the blade disclosing an arcuate edge.
Figure 7:
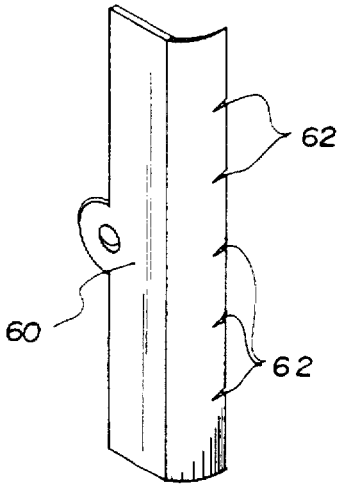
FIG. 7 is an upper side perspective view of yet another alternative embodiment of the blade disclosing notches.

As shown in FIGS. 1 through 4, the base 20 has a first passage 22 and a second passage 24 projecting parallel through the base 20 formed to slidably receive the unnumbered candle. As best shown in FIG. 3 of the drawings, a first conical member 40 having a narrow end and an enlarged end is secured to the base 20 surrounding the passage with the enlarged end. A second conical member 50 having a narrow end and an enlarged end is secured to the base 20 surrounding the passage with the enlarged end as shown in FIGS. 1 and 2 of the drawings. The second conical member 50 is preferably smaller than the first conical member 40. The first conical member 40 has a first slot 42 extending from the enlarged end to the narrow end as shown in FIG. 3. The second conical member 50 has a second slot 52 extending from the enlarged end to the narrow end. A blade 60 is removably secured (preferably by a threaded fastener 61) to the first conical member 40 within the first slot 42 projecting toward the concentric portion of the first conical member 40 to engage the candle thereby shaping the end of the candle as shown in FIG. 3. Another blade 60 is removably secured to the second conical member 50 within the second slot 52 projecting toward the concentric portion of the second conical member 50 to engage the candle thereby shaping the end of the candle. As shown in FIG. 1, a wax container 30 is removably secured to the perimeter of the base 20 enclosing the first conical member 40 and the second conical member 50 to capture the wax shavings. The blade 60 may have a swaged edge 66, an arcuate edge 64, an arcuate member in combination with the swaged edge 66 or the arcuate edge 64, or the blade 60 may have a plurality of notches 62 in combination with any of the above stated edges 64, 66, or 68.

In use, the unnumbered candle is projected through the passage 22, 24 to rotatably engage the conical member 40, 50. The unnumbered candle is manipulated to rotate against the selected blade 60 thereby shaving the wax from the unnumbered candle to form the selected shape. The wax container 30 retains the wax shavings. The user may interchange the blades 60 to achieve the desired shape of the candle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A candle sharpening system comprising:

a base having a first passage and a second passage projecting in a parallel relationship into said base for each slidably receiving a candle;

a first conical member having a narrow end and an enlarged end, and being secured to said base in a position such that said enlarged end opens into said first passage;

a second conical member having a narrow end and an enlarged end, and being secured to said base in a position such that said enlarged end opens into said second passage;

said first conical member having a first slot extending from its enlarged end to its narrow end;

said second conical member having a second slot extending from its enlarged end to its narrow end;

a blade removably secured to said first conical member within said first slot so as to project toward a concentric portion of said first conical member to engage a candle inserted into said first conical member to thereby shape an end of said candle; and a blade removably secured to said second conical member within said second slot so as to project toward a concentric portion of said second conical member to engage a candle inserted into said second conical member to thereby shape an end of said candle.

2. The candle sharpening system of claim 1 wherein a wax container is removably secured to the perimeter of said base enclosing said first conical member and said second conical member to capture wax shavings.

3. The candle sharpening system of claim 2 wherein one of said blades includes an arcuate cutting edge.

4. The candle sharpening system of claim 3 wherein said arcuate cutting edge includes a plurality of notches for forming a plurality of annular ridges on a candle shaped by said cutting edge.

5. The candle sharpening system of claim 2 wherein one of said blades includes a sharpened cutting edge.

6. The candle sharpening system of claim 5 wherein said cutting edge includes a plurality of notches for forming a plurality of annular ridges on a candle shaped by said cutting edge.

7. A candle sharpening system comprising:

a base having at least one passage for slidably receiving an end of a candle;

at least one conical member having a narrow end and an enlarged end and having said enlarged end secured to said base in a manner such that said passage opens into said enlarged end;

said conical member having a slot therein extending from said enlarged end to said narrow end; and a blade removably secured to said conical member within said slot so as to project toward a concentric portion of said conical member to engage a candle inserted into said conical member to thereby shape an end of said candle;

wherein said blade includes a sharpened cutting edge having a first end adjacent the enlarged end of said conical member and a second end adjacent the narrow end of said conical member;

wherein said cutting edge has a concavely curved shape extending continuously from the first end to the second end of said cutting edge; and wherein said cutting edge includes a plurality of V-shaped notches for forming a plurality of annular ridges on a candle shaped by said cutting edge.

8. The candle sharpening system of claim 7 wherein a wax container is removably secured to the perimeter of said base enclosing said conical member to capture wax shavings.

* * * * *